US007089626B2

(12) United States Patent
Alexander

(10) Patent No.: US 7,089,626 B2
(45) Date of Patent: Aug. 15, 2006

(54) ADJUSTABLE DOOR HINGE

(75) Inventor: Allan Alexander, London (CA)

(73) Assignee: Ford Motor Company, Dearborn, MI (US)

( * ) Notice: Subject to any disclaimer, the term of this patent is extended or adjusted under 35 U.S.C. 154(b) by 65 days.

(21) Appl. No.: 10/777,811

(22) Filed: Feb. 12, 2004

(65) Prior Publication Data

US 2005/0177976 A1 Aug. 18, 2005

(51) Int. Cl.
*E05D 7/04* (2006.01)

(52) U.S. Cl. ..... 16/249; 16/247; 16/382; 16/224

(58) Field of Classification Search ..... 16/249, 16/247 X, 382 X, 236, 240, 245, 246, 224 X, 16/239; 296/146.11, 146.12
See application file for complete search history.

(56) References Cited

U.S. PATENT DOCUMENTS 1,116,148 A * 11/1914 Southard ..... 16/247
2,200,251 A * 5/1940 Atwood ..... 16/224
3,349,429 A * 10/1967 Suska ..... 16/275
3,406,483 A * 10/1968 Mitchell ..... 49/192
3,806,158 A * 4/1974 Casey ..... 280/400
4,411,045 A * 10/1983 Rock et al. ..... 16/243
4,785,498 A * 11/1988 Brotschi ..... 16/238
4,864,690 A 9/1989 Chen
5,150,500 A * 9/1992 Bisbing ..... 16/239
5,263,227 A 11/1993 Hrbek et al.
5,555,605 A * 9/1996 Mosher ..... 16/247
5,624,150 A * 4/1997 Venier ..... 296/146.11
5,673,459 A 10/1997 Baghdasarian
5,832,565 A 11/1998 Smith
6,141,829 A * 11/2000 Boyer ..... 16/224
6,152,554 A * 11/2000 Parisi ..... 312/405
6,158,086 A * 12/2000 De Souza ..... 16/247
6,481,051 B1 11/2002 Kim

FOREIGN PATENT DOCUMENTS

FR 2673665 A3 * 9/1992
FR 2702174 A1 * 9/1994
JP 20008684 A * 1/2000
JP 2000160913 A * 6/2000
JP 2001271549 A * 10/2001

* cited by examiner

*Primary Examiner*—Chuck Y. Mah
(74) *Attorney, Agent, or Firm*—Gigette M. Bejin; Borda, Lorenz & Geggie PLLC

(57) ABSTRACT

An adjustable hinge assembly for a vehicle door in which a body-mounting plate has a spherical convex surface in moveable contact with a corresponding spherical concave surface at the base of a hinge plate permitting adjustments in the pivot axis of the hinge assembly.

13 Claims, 1 Drawing Sheet

ADJUSTABLE DOOR HINGE

BACKGROUND OF THE INVENTION

The present invention relates generally to hinges for mounting automotive vehicle doors and more particularly to self-aligning hinge assemblies to compensate for any initial misalignment of the door hinges.

Automotive doors are typically attached to the vehicle body using a pair of hinge assemblies. A hinge assembly generally consists of a door mounting plate, a body mounting plate, and a pivotal connection (hinge pin) joining the two plates. Ideally the axis of rotation of the two hinge assemblies is aligned along a single pivot axis that extends through the pins. In practice, slight variations occur during the manufacturing process in the door mounting post and the door itself. This typically results in a small misalignment of the individual pivot axes of the door hinges and can lead to reduced ease of operation, excess wear of the hinge assemblies, and misalignment of the door relative to the vehicle body, if not corrected.

U.S. Pat. No. 5,263,227 discloses a self-aligning hinge wherein the hinge pin has a spherical convex surface for engaging a concave surface of one of the hinge straps permitting variance in the relative orientation of the hinge pin to the hinge strap. U.S. Pat. No. 4,864,690 also discloses a self-aligning hinge wherein the hinge pin allows the relative orientation of hinge butts to be varied in order to align the axis of rotation of one hinge with a second hinge. The hinge pin is a slender cylinder that includes a ball-shaped part in the mid portion, upper and lower rods, and two sets of steel ball assemblies mounted on both ends of the ball-shaped part to provide rolling friction between the center shaft and the butts. In both of these patents, a complex hinge pin is used as the mechanism whereby one hinge is aligned with another hinge.

It would be desirable to have a door hinge assembly that provides for variance in the orientation of the hinge pin axis, while at the same time is simple, inexpensive, and easily manufactured.

SUMMARY OF THE INVENTION

In a preferred embodiment, the present invention provides a simple and easily manufactured vehicle door hinge assembly that can readily be adjustably aligned with a second hinge assembly during the door mounting procedure.

The adjustable hinge assembly is comprised of a door mounting plate attached to a hinge plate via a hinge pin and a vehicle body mounting plate. The body mounting plate has a generally flat surface where it is attached to the vehicle body and a spherical convex surface where it opposingly engages the hinge plate. The hinge plate has a corresponding spherical concave surface where it opposingly engages the body mounting plate. Two bolts may be used to attach the hinge assembly to the vehicle body. The body mounting plate has two corresponding apertures permitting the two bolts to pass through the plate and to subsequently be fastened to the vehicle body. The body mounting plate apertures are somewhat larger than the bolt diameters permitting the hinge plate to move relative to the body mounting plate over their opposing spherical surfaces to thereby correctly align the axis of rotation of the hinge assembly. Once the correct alignment is attained, the bolts are tightened to lock the hinge assembly in a fixed position. Of the two hinges used to mount a door, either one or both hinges may be of the self-aligning type described in the present invention.

Other aspects and advantages of the present invention will become apparent from the following detailed description, taken in conjunction with the accompanying drawings, illustrating by way of example the principles of the invention.

DETAILED DESCRIPTION

Figure 1:
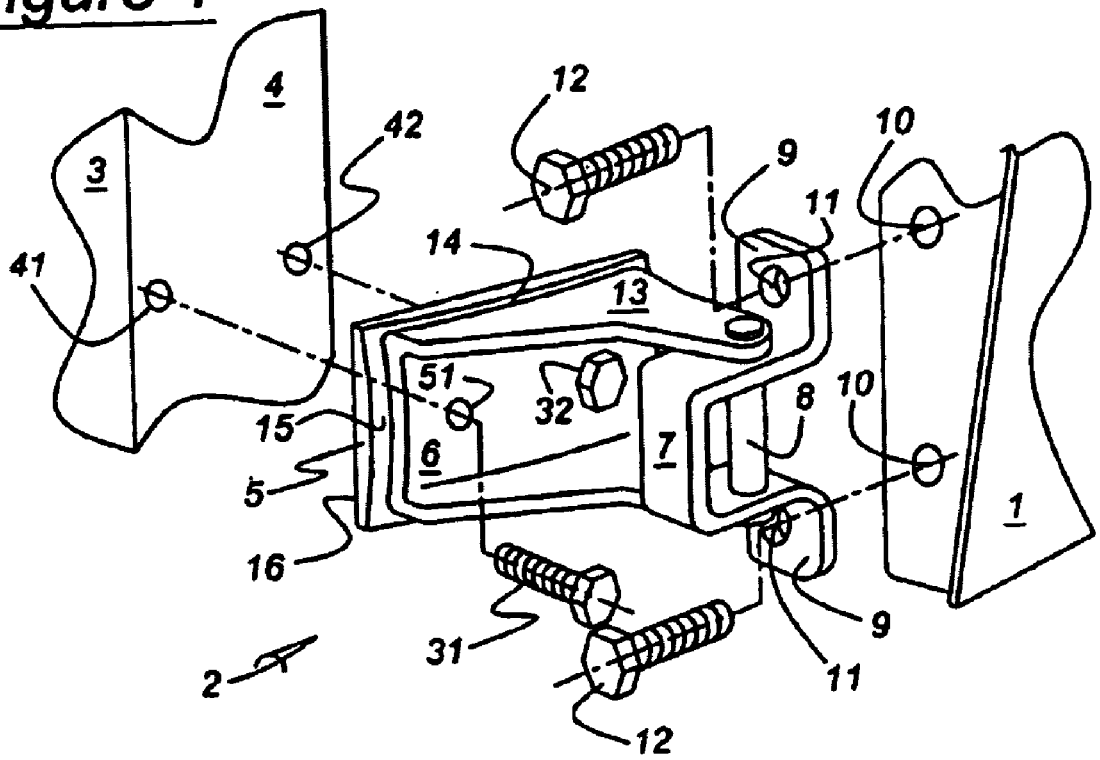
FIG. 1 is an exploded perspective view from the exterior of the vehicle illustrating how the door and hinge assembly are joined to the vehicle body.

FIG. 1 is a view from the exterior of a vehicle showing how a door 1 and hinge assembly 2 are joined to a vehicle body 3 along a door pillar 4. A vehicle door 1 is normally attached to the rigid vehicle pillar 4 with two hinges, but only one is shown in FIG. 1. One conventional door hinge assembly and an adjustable hinge assembly 2 of the present invention may be used for mounting the door 1, or two adjustable hinges assemblies 2 may be used. The hinge assembly 2 consists essentially of a separate body mounting plate 5, a hinge plate 6 that is initially loosely attached to the body mounting plate 5, and a door mounting plate 7, which is pivotally connected by a hinge pin 8 to the hinge plate 6.

The door mounting plate 7 may be formed as a U-shaped stamped steel plate with flat mounting feet 9 for abuttingly engaging the door 1. Apertures 10 are formed in the door 1 to register with apertures 11 in feet 9 and to receive bolts 12 to join the door mounting plate 7 to the door 1.

The hinge plate 6 also may be formed as a stamped steel plate. It contains a spherically concave base portion 14 and legs 13 which extend perpendicularly therefrom to retain a hinge pin 8. The door mounting plate 7 is attached to the hinge plate legs 13 via hinge pin 8.

The separate body mounting plate 5 consists of a flat face 16 on the side attached to the door pillar 4 and a spherically convex face 15 on the side opposing and abutting the spherically concave base portion 14 of the hinge plate 6. The convex spherical surface 15 of the body mounting plate 5 matches the curvature of the concave spherical surface 14 of the hinge plate 6 bottom. However, the area of the convex spherical surface 15 of the body-mounting plate 5 is slightly larger than that of the concave base portion 14 of hinge plate 6 to allow for some sliding of the hinge plate 6 over the body-mounting plate 5 when misalignments are corrected. These two spherical surfaces comprise a small solid angle portion of a sphere having an approximate radius of 10 cm in the exemplary figures. The radius can be selected, as desired, to increase or decrease the adjustment capability.

Figure 2:
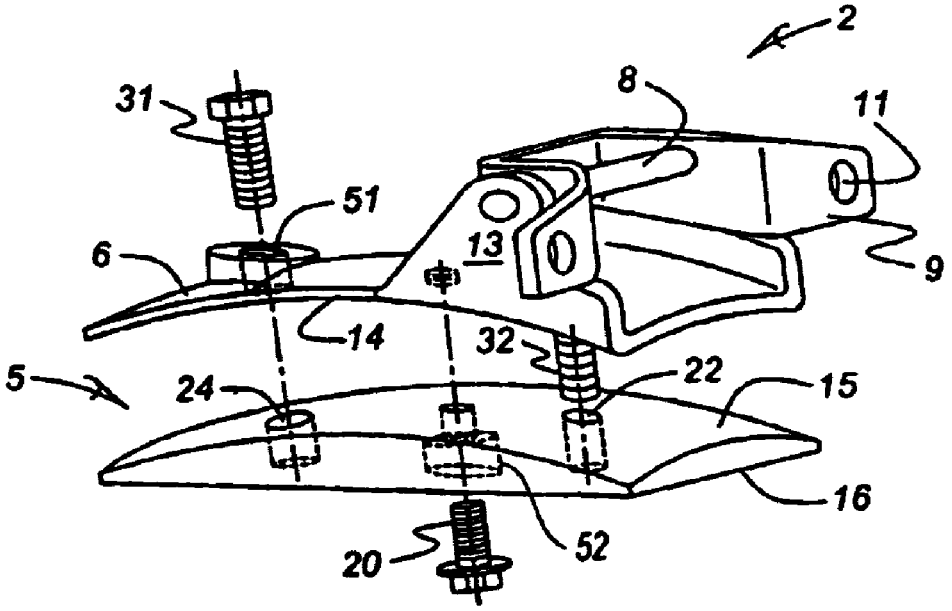
FIG. 2 is an exploded perspective view of the body mounting plate detached from the hinge plate.

FIG. 2 shows an exploded view of the adjustable hinge assembly 2 where the mounting plate 5 is shown detached form the hinge plate 6. A small bolt 20 is shown that may be used to initially loosely attach the body mounting plate 5 to the hinge plate 6. The purpose of this bolt 20 is merely to hold the body mounting plate 5 to the hinge plate 6 during the process of attaching the door 1 to the body 3. It loosely holds the two plates together through an oversized aperture 52 in the body mounting plate 5, allowing some freedom of movement between the convex surface 15 of the body mounting plate 5 and the concave surface 14 of the hinge plate 6. A wire or other flexible attachment device also could be used to fulfill this function.

The hinge plate 6 has a first aperture 51 for receiving the insertion of a first attachment bolt 31. The body mounting plate 5 has a corresponding aperture 24 that has a diameter slightly larger than the shank of bolt 31, allowing relative movement between the hinge plate 6 and the body-mounting plate 5 prior the tightening. In the preferred embodiment a second attachment bolt 32 is longitudinally attached to the hinge plate base 6. It extends from hinge base plate 6 and passes through a second aperture 22 in the body-mounting plate 5. The second aperture 22 is slightly greater in diameter than the shank of bolt 32. Alternatively, the second bolt 32 may be insertable through the hinge plate 6, similar to the first bolt 31. The two body-mounting plate apertures 24, 22 and bolts 31, 32 correspondingly register with apertures 41, 42 in the door pillar 4.

The door is attached to the vehicle body by the following preferred procedure. The adjustable hinge assembly 2 with the body mounting plate 5 loosely attached to the hinge plate 6 is first attached to the door 1 via bolts 12 being threaded into apertures 10. Two bolts 31, 32 then are used to attach the adjustable hinge assembly 2 to the body pillar 4. Bolt 32 is longitudinally retained by and is an integral part of the hinge plate 6. Therefore, as the door 1 with the hinge assembly 2 is positioned on the vehicle, bolt 32 aids in guiding alignment of the hinge with receiving aperture 42. Bolt 31 is then inserted through aperture 51 of the hinge plate 6 and through aperture 21 of the body mounting plate 5. It is threadedly received by aperture 41 of the door pillar 4. Initially, bolts 31 and 32 are not tightened completely, until a second hinge is securely attached. The second hinge, which may be a conventional hinge or another adjustable door hinge, is securely attached to the door 1 and the door pillar 4 at a spaced apart and predetermined location—not shown. When both hinges are attached between the door 1 and the pillar 4, and the door is closed, a final alignment of the hinge pins occurs. The loosely connected adjustable hinge assembly allows the hinge pin 8 to become aligned with the pivot axis established by the second hinge. Then, as the bolts 31 and 32 are tightened/secured, the spherical surface interface of the adjustable hinge assembly 2 is compressed and forced into sliding engagement to compensate for and allow the correct alignment of the two hinge pin axes to be retained.

What is claimed is:

1. An adjustable hinge assembly pivotally mounting a vehicle door to a vehicle body structure about an axis of rotation, comprising:

a door mounting plate;

a hinge plate that is pivotally connected to said door mounting plate by a hinge pin, said hinge plate having a spherically concave bottom surface;

a body-mounting plate having a first flat surface for attachment to said vehicle body structure and a second spherically convex surface for engaging said spherically concave bottom surface of said hinge plate;

means for adjustably attaching said hinge plate to said body-mounting plate; and means for attaching said adjustable hinge assembly to said vehicle body structure once a desired axis of rotation alignment has been achieved.

2. An adjustable hinge assembly as in claim 1, wherein said means for adjustably attaching said hinge plate to said body-mounting plate is a bolt that is longitudinally retained to extend from said hinge plate and through an oversized aperture in said body mounting plate, whereby said body-mounting plate has some freedom of movement with respect to said hinge plate over their respective spherical surfaces.

3. An adjustable hinge assembly as in claim 1, wherein said means for attaching said adjustable hinge assembly to said vehicle body structure is by a first bolt that is longitudinally retained to extend from said hinge plate and passing through an oversized aperture in said body-mounting plate and into said vehicle body structure and a second bolt passing through an aperture in said hinge plate and through an oversized aperture in said body-mounting plate and into said vehicle body structure.

4. An adjustable hinge assembly as in claim 3, wherein said first bolt is not fixedly attached to said hinge plate and it and said second bolt each pass through an aperture in said hinge plate and through oversized apertures in said body-mounting plate and on to said vehicle body structure.

5. A method of mounting a vehicle door to a vehicle body structure using an adjustable hinge assembly, said adjustable hinge assembly having a door mounting plate, a hinge plate that is pivotally connected to the door mounting plate by a hinge pin, said hinge plate having a spherically concave bottom surface, and a body-mounting plate having a first flat surface for attachment to said vehicle body structure and a second spherically convex surface for engaging said spherically concave bottom surface of said hinge plate, the method comprising:

attaching a first adjustable hinge assembly to said vehicle door;

attaching a second hinge assembly to said vehicle door;

fixedly attaching said second hinge assembly to said vehicle body structure;

loosely attaching said first adjustable hinge assembly to said vehicle body structure aligning said first adjustable hinge assembly with said second hinge assembly by sliding the spherically concave bottom surface of said hinge plate against the spherically convex surface of the body-mounting plate; and fixedly attaching said first adjustable hinge assembly to said vehicle body structure.

6. A method of mounting a vehicle door to a vehicle body structure as in claim 5, wherein said second hinge assembly is an adjustable hinge assembly and wherein said second adjustable hinge assembly is first loosely attached to said vehicle body structure prior to aligning the vehicle door with respect to said vehicle body.

7. A hinge assembly for providing pivot axis adjustment while mounting a door to a body, comprising:

a body mounting plate member having a first surface that is attachable to said body and a second surface defining a portion of a sphere of predetermined radius;

a hinge plate member having a first portion that retains a hinge pin along a first pivot axis and a second portion with an adjustment surface defining a portion of a sphere corresponding in shape to said second surface of said body mounting plate member; and a door mounting member having a first portion that is attachable to said door and a second portion connected to said hinge pin for pivoting about said first pivot axis, wherein said corresponding spherical surfaces are in opposition to allow movement therebetween over their respective spherical surfaces and to seek alignment of said hinge pin with the pivot axis of a second hinge assembly mounted between said body and said door during the process of mounting the door to body.

8. An adjustable hinge assembly as in claim 7, wherein said second spherical surface of said body mounting plate member is convex and said adjustment spherical surface is concave.

9. An adjustable hinge assembly as in claim 8, wherein the area of said second surface of said body mounting plate member is larger than the area of said adjustment surface.

10. An adjustable hinge assembly as in claim 8, wherein said body mounting plate member and said hinge plate member are loosely connected together with said spherical surfaces in substantial opposition during the process of mounting the door to body.

11. A method of adjusting the pivot axis of a first hinge while mounting a door to a body, comprising the steps of:

providing a body mounting plate member having a first surface that is attachable to said body and a second surface defining a portion of a sphere of predetermined radius;

providing a hinge plate member having a first portion that retains a hinge pin along a first pivot axis and a second portion with a adjustment surface defining a portion of a sphere corresponding in shape to said second surface of said body mounting plate member;

providing a door mounting member having a first portion that is attachable to said door and a second portion connected to said hinge pin for pivoting about said first pivot axis;

orienting said corresponding spherical surfaces in opposition to allow movement therebetween;

providing a second hinge between said door and said body;

securely attaching said second hinge at a predetermined location between said door and said body to define the pivot axis of said door;

securely attaching said door mounting member to said door;

loosely attaching said body mounting plate member and said hinge plate member to said body;

allowing said hinge pin to seek alignment with the pivot axis of said second hinge assembly; and securing said attachment of said body mounting plate member and said hinge plate member to said body.

12. A method as in claim 11, wherein said body mounting plate member is provided with a convex surface and said hinge plate member is provided with a concave adjustment surface.

13. A method as in claim 12, wherein the area of said second surface of said body mounting plate member is provided with a larger area than that of said adjustment surface.

* * * * *